US006354232B1

(12) United States Patent
Hulke

(10) Patent No.: US 6,354,232 B1
(45) Date of Patent: Mar. 12, 2002

(54) ADJUSTING SHELVING SYSTEM

(76) Inventor: Donald B. Hulke, 8037 Xerxes Ave. S. #236, Bloomington, MN (US) 55431

( * ) Notice: Subject to any disclaimer, the term of this patent is extended or adjusted under 35 U.S.C. 154(b) by 0 days.

(21) Appl. No.: 09/636,227

(22) Filed: Aug. 10, 2000

(51) Int. Cl.[7] ..... A47B 5/00
(52) U.S. Cl. ..... 108/149
(58) Field of Search ..... 108/149, 151, 108/180; 160/393, 392, 893

(56) References Cited

U.S. PATENT DOCUMENTS 2,244,887 A * 6/1941 Manley ..... 108/149 X
3,799,072 A * 3/1974 Slaboden ..... 108/149 X
4,187,787 A * 2/1980 Nakatsu ..... 108/149 X
4,295,432 A * 10/1981 Hulke ..... 108/149
5,052,648 A * 10/1991 Landau ..... 108/149 X
5,427,344 A * 6/1995 Beauchemin ..... 108/149
5,542,530 A * 8/1996 Freelander ..... 108/149 X

FOREIGN PATENT DOCUMENTS

FR 2458246 * 2/1981 ..... 108/149
GB 222248 * 10/1924 ..... 108/149

* cited by examiner

*Primary Examiner*—Jose V. Chen
(74) *Attorney, Agent, or Firm*—Kinney & Lange

(57) ABSTRACT

An improved hanging shelf system has shelves suspended from a webbing. The shelves can be adjusted along the webbing to be spaced at any distance. The manner in which the shelves are suspended is hidden from view making it more aesthetically pleasing.

20 Claims, 4 Drawing Sheets

ADJUSTING SHELVING SYSTEM

CROSS-REFERENCE TO RELATED APPLICATION(S)

None.

BACKGROUND OF THE INVENTION

The present invention relates to hanging shelves suspended from a webbing, and in particular, the present invention relates to hanging shelves wherein the manner in which the shelf and the webbing are attached is adjustable and concealed from view.

Hanging shelves suspended from a support directly overhead are useful as space-savers. They do not need floor space as conventional storage devices such as bookshelves. Hanging shelves may also be used away from walls, giving the user a further flexibility that is not found in the typical shelving arrangement, which is usually directly attached to a wall. Further, a hanging shelf suspended from an overhead support gives a room added dimension when such items such as house plants are placed on display on the shelves.

The Hulke patent, U.S. Pat. No. 4,295,432, has been very successful in this market. The adjustability of the shelves makes it highly functional, while at the same time, the manner in which the shelves are suspended from the webbing make it very aesthetically pleasing. Though the shelving system has been successful and sold thousands, certain problems still exist with the shelving apparatus. For instance, adjusting the shelves along the webbing required that the whole unit be taken apart. Also, inserting the webbing back into the shelves requires a tool that is not attached to the shelving unit making it easy to lose the tool. Therefore, there exists a need to improve upon these problems to make a better hanging shelf system.

BRIEF SUMMARY OF THE INVENTION

The present invention includes a hanging shelf having a shelf with a pair of opposing sides, each side having a bore proximate its ends. The bore communicates with a slot which in turn communicates with the exterior of the shelf. A webbing is inserted within the slot and the bore. A key is inserted within the bore and has a first position such that the webbing easily slides back and forth through the slot and bore to adjust the position of the shelf along the webbing. The key also has a second position that locks the webbing in place by frictionally engaging the surface of the bore.

DETAILED DESCRIPTION

Figure 1:
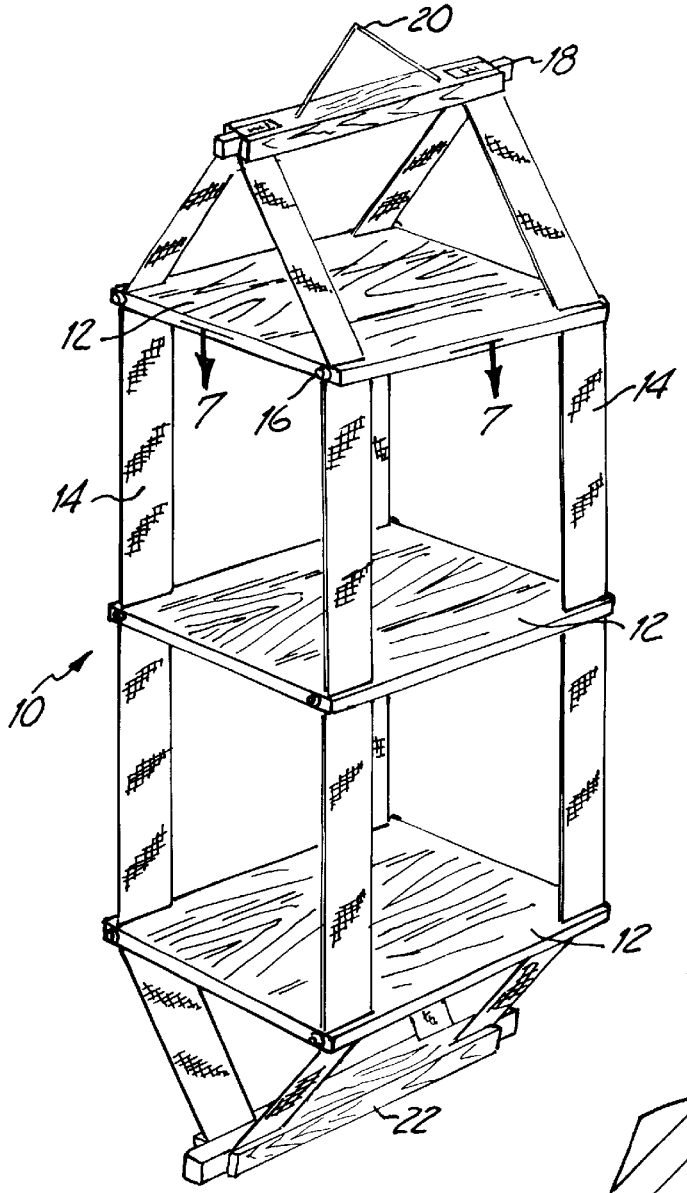
FIG. 1 is a perspective view of the present invention.

FIG. 1 is the preferred embodiment of the present invention. Hanging shelf system 10 includes individual shelves 12, webbing 14, keyhead 16, top end bar 18, hanger 20, and bottom end bar 22.

Shelf 12 is suspended from webbing 14 through a mechanism which is hidden from view primarily by keyhead 16. Webbing 14 can be canvas or any type of sturdy, flexible fabric. One or more shelves 12 can be suspended from webbing 14 and adjusted to be spaced by any desired distance. Top end bar 18 attaches to webbing 14 above the highest suspended shelf 12. Hanger 20 attaches to top end bar 18 for suspending hanging shelf system 10 from a desired location. Bottom end bar 22 attaches to webbing 14 below the lowest suspended shelf 12. Objects such as towels can be placed on bottom end bar 22 for storage or other objects can be placed on bottom end bar 22 for a decorative effect.

Figure 2:
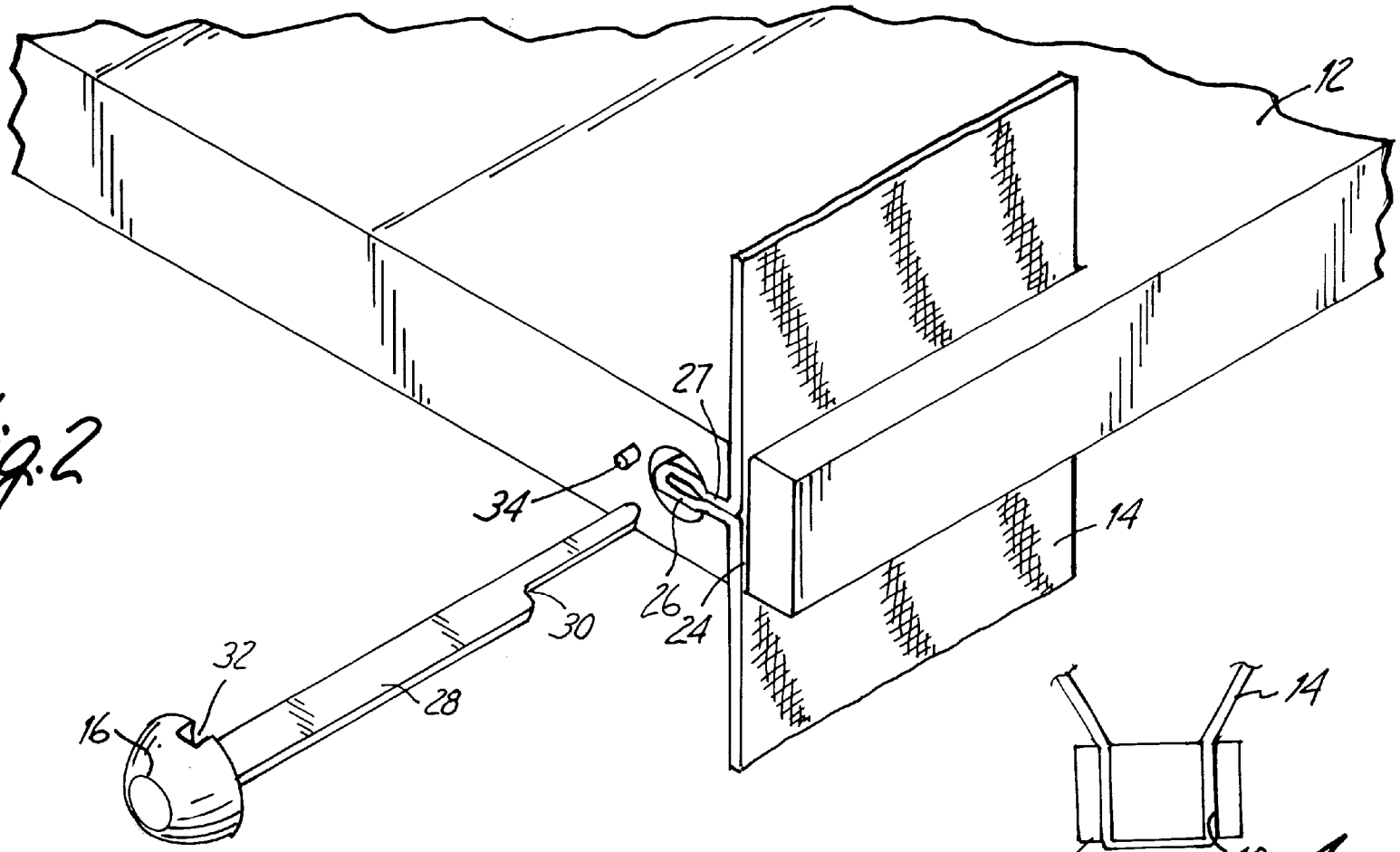
FIG. 2 is a fragmentary perspective view showing the manner in which the webbing is inserted into the shelf.

FIG. 2 illustrates how webbing 14 is inserted into hanging shelf system 10. FIG. 2 shows shelf 12, webbing 14, keyhead 16, slot 24, bore 26, connecting slot 27, key 28 with step 30, notch 32, and dowel 34.

In operation, webbing 14 inserts into slot 24 of shelf 12. Slot 24 communicates with bore 26 along connecting slot 27. Key 28 guides webbing 14 into bore 26 by pushing a section of webbing 14 from slot 24 through connecting slot 27 and into bore 26 with key 28. Key 28 is positioned perpendicular to slot 24 with step 30 directed toward slot 24. Keyhead 16 makes manipulating key 28 easier and contains notch 32, which engages dowel 34 for locking key 28 in place. Once webbing 14 is properly inserted, shelf 12 can be adjusted and secured in place.

Figure 3:
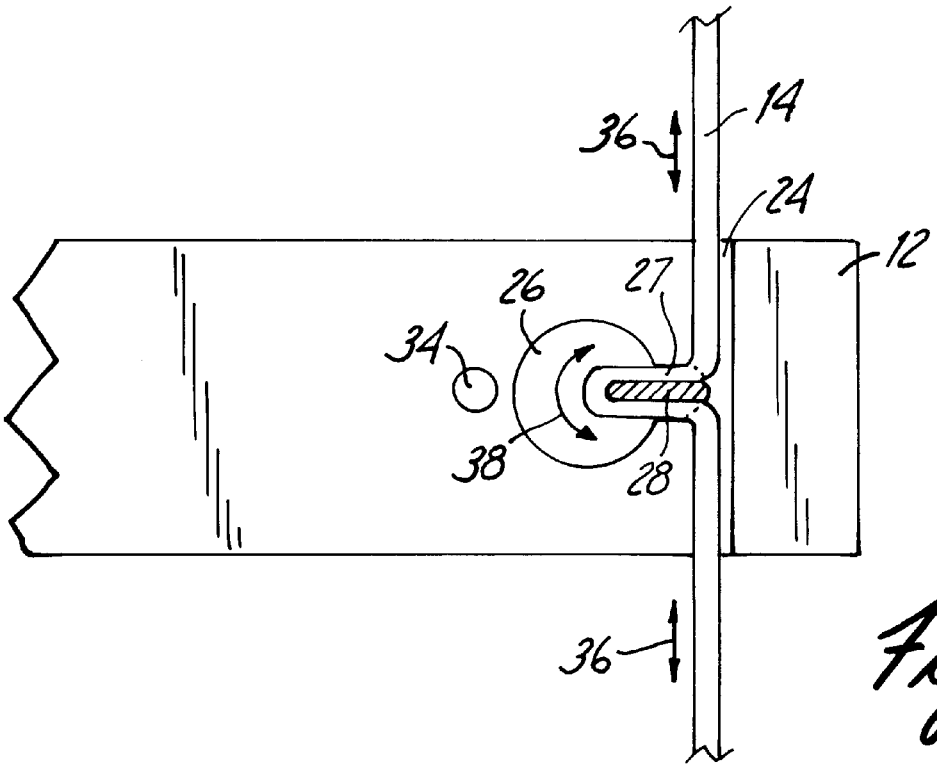
FIG. 3 is a fragmentary cross-sectional view of the shelf in the unsecured state.
Figure 4:
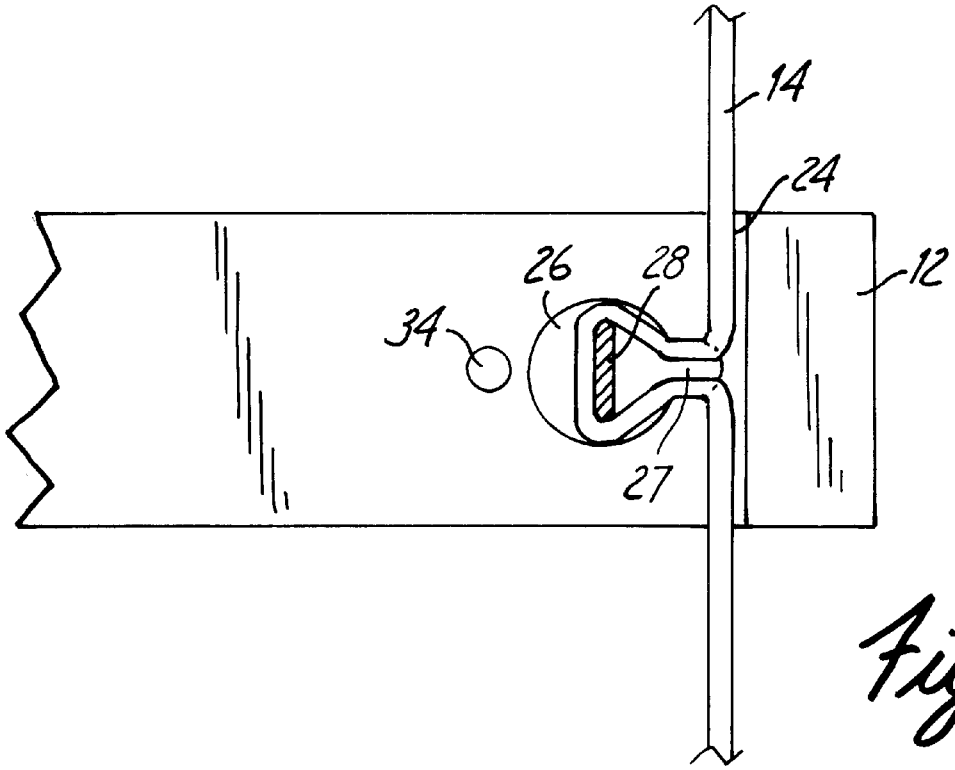
FIG. 4 is a fragmentary cross-sectional view of the shelf in the secured state.

FIGS. 3 and 4 illustrate the position of key 28 within bore 26 in the unsecured and secured positions, respectively. FIGS. 3 and 4 include shelf 12, webbing 14, slot 24, bore 26, connecting slot 27, key 28, and dowel 32. FIG. 3 additionally includes double-headed arrows 36 and 38.

Referring now to FIG. 3, as webbing 14 is inserted into slot 24 and guided through connecting slot 27 and into bore 26 by key 28 as described in FIG. 2, webbing 14 can easily be pulled in either direction along the length of webbing 14. Double-headed arrows 36 and 38 show the movement of webbing 14 through slot 24, connecting slot 27, and bore 26. Shelf 12 can be positioned anywhere along webbing 14.

In FIG. 4, key 28 is rotated so that it is parallel with slot 24. In this position, webbing 14 can no longer be pulled through slot 24, connecting slot 27, and bore 26. Webbing 14 frictionally engages the surface of bore 26 and therefore, shelf 12 is secured to and suspends from webbing 14.

Figure 5:
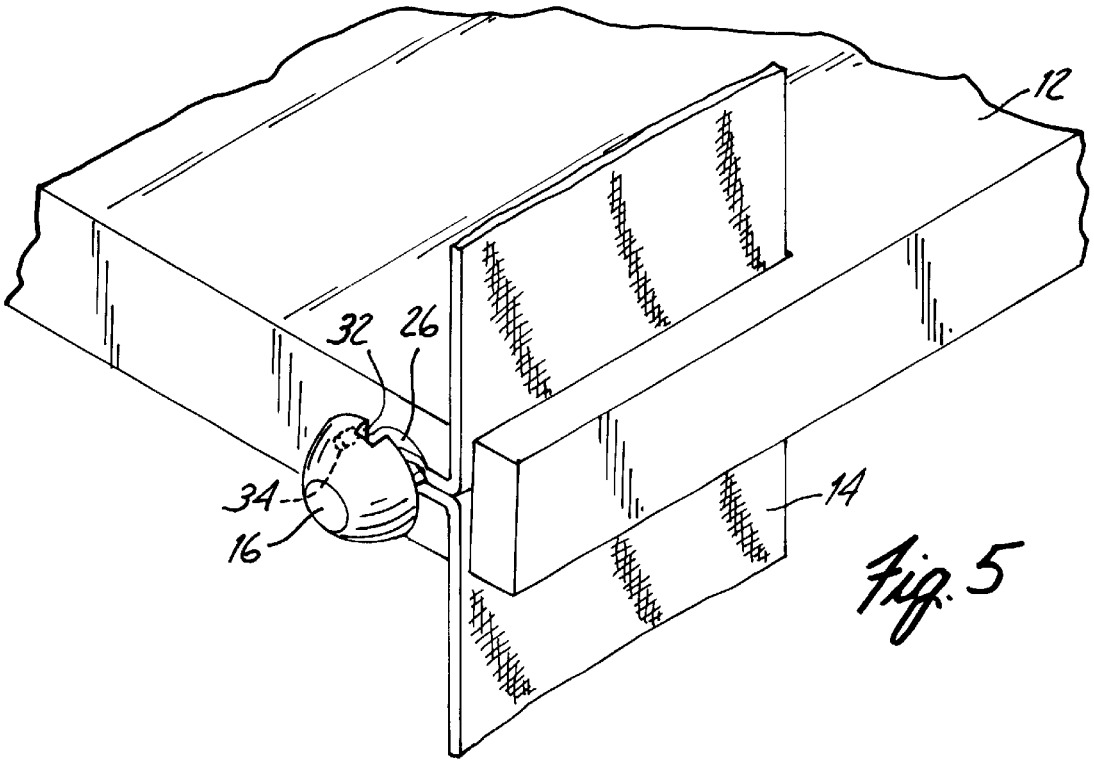
FIG. 5 is a fragmentary perspective view showing the head in the unsecured position.
Figure 6:
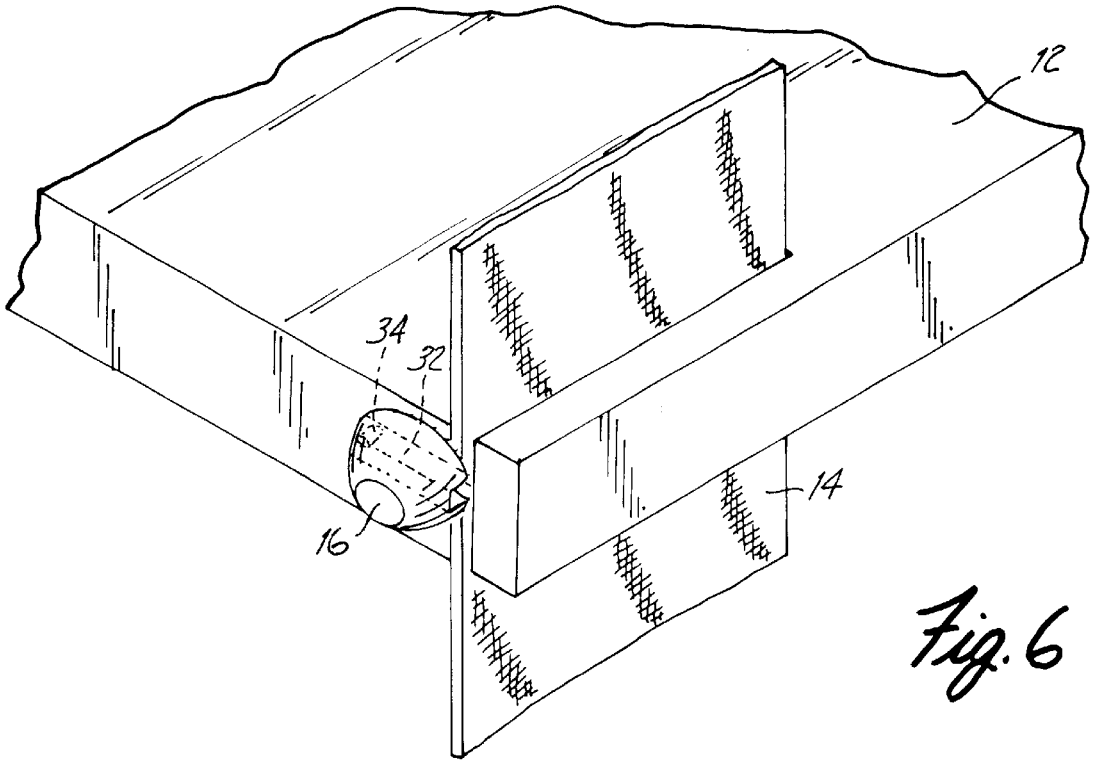
FIG. 6 is a fragmentary perspective view showing the head in the secured position.

FIGS. 5 and 6 illustrate the position of keyhead 16 in the unsecured and secured positions, respectively. FIGS. 5 and 6 include shelf 12, webbing 14, keyhead 16, notch 32, and dowel 34. FIG. 5 additionally shows bore 26 and connecting slot 27.

As shown in FIG. 5, notch 32 of keyhead 16 is one quarter turn from dowel 34 in the unsecured position and, therefore, does not engage dowel 34. FIG. 6 shows notch 32 and dowel 34 aligned and engaged. Engagement of notch 32 and dowel 34 prevents key 28 from rotating, which would allow shelf 12 to slip down along webbing 14. In the preferred embodiment, as shown in FIG. 6, notch 32 extends from one side of keyhead 16 to the other allowing keyhead 16 to be rotated in either direction for engaging notch 32.

Figure 7:
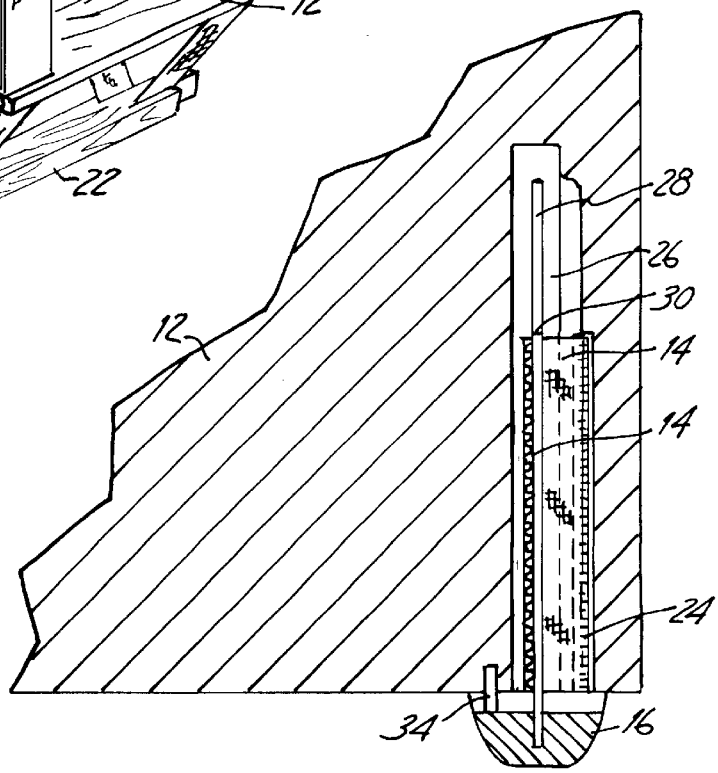
FIG. 7 is a fragmentary cross-sectional view along line 7—7 of FIG. 1.

FIG. 7 is a cross-sectional view through shelf 12, while in a secured position, showing the relative lengths of slot 24 and bore 26. FIG. 7 includes shelf 12, webbing 14, keyhead 16, slot 24, bore 26, key 28 with step 30, and dowel 34.

In operation, webbing 14 is secured in position and comes in and around key 28 and out through slot 24. When dowel 34 is disengaged from notch 32 and key 28 is rotated one quarter turn, webbing 14 can be pulled in either direction to adjust shelf 12 along webbing 14. Preferably, the length of bore 26 is longer than the length of slot 24, and the change in lengths corresponds with step 30 of key 28. Recesses are cut into the surface of bore 26 (not seen in this view) to accommodate the different widths of key 28. The extra length of bore 26 and key 28 prevent key 28 from slipping out through slot 24 while shelf 12 is adjusted along webbing 14, which makes the process much easier.

Figure 8:
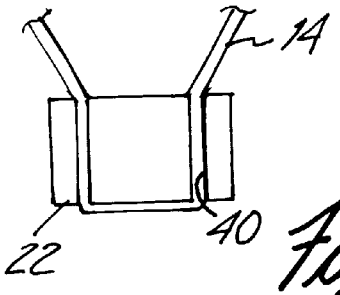
FIG. 8 is an end view showing the manner in which webbing is inserted into the bar.

FIG. 8 illustrates webbing 14 engaged with bottom end bar 22. FIG. 8 includes webbing 14 and bottom end bar 22 with end bar slot 40. As shown, webbing 14 inserts into end bar slot 40 of bottom end bar 22. End bar slots 40 are located at each end of top and bottom end bars 18 and 22. Webbing 14, in the preferred embodiment, is formed from two continuous belts. Inserting webbing 14 into end bar slots 40 of top and bottom end bars 18 and 22 is the preferred embodiment shown in FIG. 1, and provides a means to hang the shelves and also offers more storage capacity. In addition, it gives a more aesthetically pleasing appearance to hanging shelf system 10.

Although the present invention has been described with reference to preferred embodiments, workers skilled in the art will recognize that changes may be made in form and detail without departing from the spirit and scope of the invention.

What is claimed is:

1. A hanging shelf apparatus comprising:

webbing;

a shelf having a pair of opposing sides and an upper and a lower surface, each side having a bore proximate both ends, the bore having a length longer than a width of the webbing and a slot with a length approximately equal to the width of the webbing, the slot communicating with and along the bore and communicating with the upper and lower surfaces of the shelf, the bore being positioned to receive and hold the webbing such that the webbing extends through the slot and beyond the upper and lower surfaces; and a key that fits inside the bore such that in a first position the key permits the webbing to slide through the bore and in a second position the key secures the webbing in place so that the webbing frictionally engages a surface of the bore to connect the webbing and the shelf.

2. The apparatus of claim 1 and further comprising:

a head at one end of the key having a width larger than the width of the bore and a notch; and a dowel next to the bore, the dowel having a size that allows engagement with the notch and locks the key into the second position.

3. The apparatus of claim 1 wherein the key is notched such that a first section of the key is wider than a second section of the key, the second section extending beyond the length of the slot.

4. The apparatus of claim 3 wherein the bore has recesses to fit the first and second sections of the key.

5. The apparatus of claim 3 wherein the second section of the key prevents the key from slipping out of the bore when the webbing is slid through the bore.

6. The apparatus of claim 1 wherein the webbing is a flexible, continuous belt.

7. The apparatus of claim 1 and further comprising:

a plurality of spaced apart shelves suspended from and attached to the webbing.

8. The apparatus of claim 1 and further comprising:

an end bar having two slots at each end with a length equal to at least the width of the webbing, the webbing being insertable within the slots; and a means for hanging, attached to the end bar, for hanging the hanging shelf apparatus.

9. A hanging shelf apparatus comprising a plurality of shelves suspended from webbing, the shelves having a bore and slot, which communicate, proximate to each end of the shelves and, the slot communicating with a top and bottom side of each shelf, the improvement comprising:

a key that in a first position allows the webbing to slide through the bore and slot and in a second position locks the webbing by frictionally engaging the webbing to a surface of the bore.

10. The apparatus of claim 9 and further comprising:

a head with a notch at one end of the key, the head having a width larger than the bore; and a dowel, next to the bore, the dowel having a size that allows engagement with the notch and when engaged locks the key in the second position.

11. The apparatus of claim 9 wherein the key extends beyond the length of the slot.

12. The apparatus of claim 11 wherein the key does not slip out of the bore as the webbing slides through the bore and slot.

13. The apparatus of claim 9 and further comprising:

a plurality of spaced apart shelves suspended from and attached to the webbing.

14. The apparatus of claim 9 and further comprising:

an end bar having two slots at each end with a length equal to at least the width of the webbing, the webbing being insertable within the slots; and a means for hanging attached to the end bar.

15. The apparatus of claim 14 wherein end bars are attached at the top and bottom of the shelving apparatus.

16. A hanging shelf apparatus comprising:

four webbings;

a shelf having four corners, two opposing sides, a front and back, and a top and bottom, the shelf having a slot and bore that receive the webbing near each comer, the slot and bore are parallel to the front and back so that the webbing is parallel to the front and back; and four keys that insert into the bores at the sides of the shelf, the keys having a first position that allow the webbings to slide through the slots and bores and a second position that frictionally engages the webbings with the shelf, the keys having a head at one end that is wider than the bores and conceals the manner in which the webbings are attached to the shelf.

17. The apparatus of claim 16 wherein the four webbings are part of two continuous belts.

18. The apparatus of claim 16 and further comprising:

a notch on each head; and a dowel near each bore, which engages with the notch to secure the key in the appropriate position to attach the webbing to the shelf.

19. The apparatus of claim 18 wherein two notches are placed on opposing sides of the head.

20. The apparatus of claim 16 and further comprising:

two ends bars having opposing ends and connected to the webbings, one end bar centered above the shelf and one end bar centered below the shelf and parallel to the sides of the shelf, each end bar having two slots at each end where the webbings attach to the end bars; and a means for hanging the hanging shelf apparatus attached to the end bar centered above the shelf.

* * * * *